US005516035A

United States Patent [19]

Stone

[11] Patent Number: 5,516,035

[45] Date of Patent: May 14, 1996

[54] TRAY-LID ASSEMBLY

[75] Inventor: James L. Stone, Grand Rapids, Mich.

[73] Assignee: Packaging Corporation of America, Evanston, Ill.

[21] Appl. No.: 512,891

[22] Filed: Aug. 9, 1995

[51] Int. Cl.[6] ..... B65D 43/02

[52] U.S. Cl. ..... 229/123.2; 53/492; 229/207; 229/125.35

[58] Field of Search ..... 229/207, 123.2, 229/123.3, 125.35; 220/276, 359; 53/492

[56] References Cited

U.S. PATENT DOCUMENTS

| | | | |
|---|---|---|---|
| 3,054,680 | 9/1962 | Mennen . | |
| 3,185,578 | 5/1965 | Scharre | 229/207 |
| 3,244,356 | 4/1966 | Wolowicz et al. . | |
| 3,399,820 | 9/1968 | Foster et al. | 229/207 |
| 3,942,676 | 3/1976 | Beckers et al. | 220/359 |
| 4,285,461 | 8/1981 | Meyers . | |
| 4,288,027 | 9/1981 | Peterson . | |
| 4,312,451 | 1/1982 | Forbes, Jr. . | |
| 4,351,473 | 9/1982 | Manizza . | |
| 4,449,633 | 5/1984 | Johnson et al. | 229/207 |
| 4,491,224 | 1/1985 | Horvath | 229/125.35 |
| 4,531,668 | 7/1985 | Forbes, Jr. | 229/207 |
| 4,687,104 | 8/1987 | Ielmini . | |
| 4,738,365 | 4/1988 | Prater . | |
| 4,871,071 | 10/1989 | Zimmermann . | |
| 4,944,451 | 7/1990 | Forbes, Jr. . | |
| 4,951,824 | 8/1990 | Kuchenbecker et al. | 229/207 |
| 4,955,530 | 9/1990 | Rigby et al. . | |
| 4,961,494 | 10/1990 | Alexander . | |
| 4,962,849 | 10/1990 | Anderson . | |
| 5,011,006 | 4/1991 | Anderson . | |
| 5,028,273 | 1/1992 | Kuchenbecker | 229/207 |
| 5,090,615 | 2/1992 | Hopkins et al. . | |
| 5,167,339 | 12/1992 | Takata et al. . | |
| 5,234,159 | 8/1993 | Lorence et al. . | |

*Primary Examiner*—Gary E. Elkins
*Attorney, Agent, or Firm*—Arnold, White & Durkee

[57] ABSTRACT

A tray-lid assembly comprises a tray and a lid. The tray includes a bottom panel, a continuous wall panel, and a continuous rim. The continuous wall panel encompasses the bottom panel and extends upwardly from the bottom panel. The continuous rim encompasses an upper edge of the continuous wall panel and projects laterally outwardly therefrom. The lid includes an upper surface and a lower surface. The lower surface of the lid is detachably connected to the continuous rim. The lid has a first inside cut score formed in the lower surface of the lid. The lid has an outside cut score formed in the upper surface of the lid. The outside cut score bridges the periphery of the lid at two points to divide the lid into a main section and a relatively small corner tab. The first inside cut score and the outside cut score are generally parallel and in proximity to each other. The first inside cut score and the outside cut score form a rev cut such that the lid delaminates in a first delamination region between the first inside cut score and the outside cut score in response to pressing down on the corner tab. Additional inside cut scores are preferably provided to facilitate removal of the corner tab from the tray.

21 Claims, 4 Drawing Sheets

TRAY-LID ASSEMBLY

FIELD OF THE INVENTION

The present invention relates to food and liquid containers, such as packaged food cartons and boxes. Specifically, the present invention relates to an improved tray-lid assembly for easily and cleanly opening food or liquid containers.

BACKGROUND OF THE INVENTION

The use of tray-lid assemblies in packaging food and liquid products has been increasing in recent years due to their suitability in both conventional and microwave ovens. A tray-lid assembly includes a tray and a lid detachably connected to the tray. The tray typically includes a bottom panel, a continuous wall panel, and a continuous rim. The continuous wall panel encompasses the bottom panel and extends upwardly and often outwardly from the bottom panel. The continuous rim encompasses an upper edge of the continuous wall panel and projects laterally outwardly therefrom. The lower surface of the lid is detachably connected to the continuous rim to provide a hermetic seal which prevents water, moisture and bacteria from contacting food and liquid products within the tray-lid assembly, thereby making the products freezer-stable and shelf-stable. In the past, the seal attaching the lid to the tray has been difficult to initially open. In addition, there have been problems insuring that the food or liquid product has not been contaminated with lid fragments during the process of removing the lid. Therefore, a means for effectively opening the lid from the tray without contaminating the food or liquid is very desirable.

While various tray-lid designs have been proposed in U.S. Pat. Nos. 4,531,668, 4,871,071, 4,955,530, 4,961,464, 4,962,849, 5,090,615 and 5,234,159, the designs have failed to efficiently and effectively address the problems noted above. The designs have also failed to address problems such as creating an opening in the lid which can facilitate venting or dispersal of steam generated during microwave cooking. Therefore, there exists a need for such a tray-lid assembly which can obtain the lid removal objectives and the venting objectives.

SUMMARY OF THE INVENTION

An object of the present invention to provide a tray-lid assembly which the consumer can conveniently open without contaminating any of the food or liquid product. A related object of the present invention is to provide a tray-lid assembly that after removing the lid leaves the tray in a condition whereby the food or liquid product can be efficiently poured and/or removed from the tray. In addition, the clean removal of a substantial portion of the lid from the tray also makes the food or liquid products seem more visibly appealing.

Another object of the present invention is to provide a tray-lid assembly that is capable of forming a vent hole for the cooking process.

The tray-lid assembly embodying the present invention provides an effective solution for meeting the above objectives. The tray-lid assembly comprises a tray and a lid. The tray includes a bottom panel, a continuous wall panel, and a continuous rim. The continuous wall panel encompasses the bottom panel and extends upwardly from the bottom panel. The continuous rim encompasses an upper edge of the continuous wall panel and projects laterally outwardly therefrom. The lid includes an upper surface and a lower surface. The lower surface of the lid is detachably connected to the continuous rim. The lid has a first inside cut score formed in the lower surface of the lid. The lid has an outside cut score formed in the upper surface of the lid. The outside cut score bridges the periphery of the lid at two points to divide the lid into a main section and a relatively small corner tab. The first inside cut score and the outside cut score are in proximity to each other and form a rev cut such that the lid delaminates in a first delamination region between the first inside cut score and the outside cut score in response to pressing down on the corner tab. Additional inside cut scores are preferably provided to facilitate detachment and removal of the main section and corner tab of the lid from the tray.

In a preferred embodiment, the first inside cut score and outside cut score are arc shaped and generally parallel to each other. Both the first inside cut score and the outside cut score are preferably arc shaped to conform with the contours of the thumb because the delamination process is preferably initiated by a consumer pressing down on the corner tab with the thumb. The process of pressing down on the corner tab will result in the formation of a cooking vent.

Figure 1:
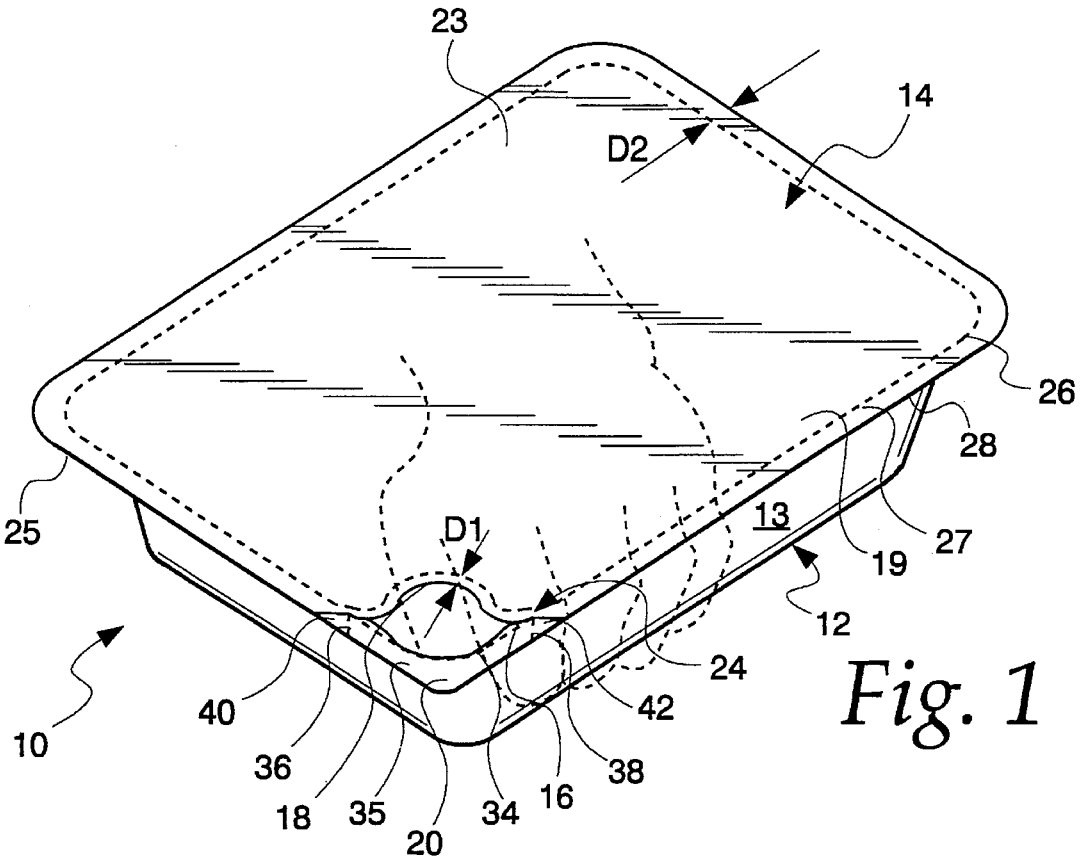
FIG. 1 is a perspective view of a tray-lid assembly embodying the present invention, illustrating the pressing of a corner tab resulting in delamination and venting.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Turning now to the drawings and referring to FIG. 1–4, 7 and 8, there is shown a tray-lid assembly 10 which comprises a tray 12 and a lid 14. The tray 12 is preferably composed of either plastic or paperboard. The tray 12 includes a bottom panel 11, a continuous wall panel 13 and a continuous rim or tray flange 25. The continuous wall panel 13 encompasses the bottom panel 11 and extends upwardly from the bottom panel 11. The continuous rim or tray flange 25 encompasses an upper edge of the continuous wall panel 13 and projects laterally outwardly from there.

The lid 14 is preferably composed of paperboard and, more specifically, SBS (solid bleach sulfate). The lid 14 has a lower surface 21, as shown in FIG. 3, 4, 6–10, and is adapted to be adhered or otherwise affixed to the laterally extending continuous rim or flange 25 on the tray 12 to properly seal the tray-lid assembly 10. The lid 14 is attached to the tray 12 of the tray-lid assembly 10 by a hot melt or cold adhesive. Although a preferred adhesive is PET, various other adhesives can be used, as well as other means for securing the lid 14 on the tray 12.

Figure 2:
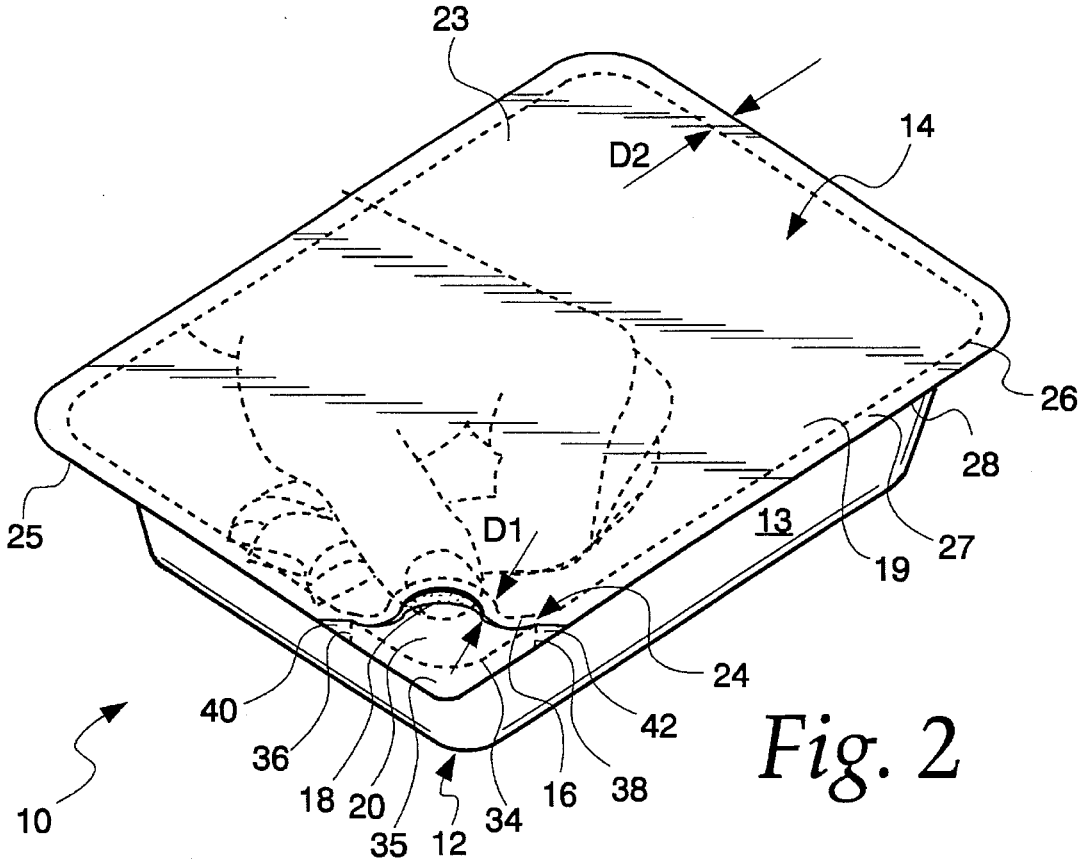
FIG. 2 is a perspective view of the tray-lid assembly illustrating the grasping of a main section of the lid at a location adjacent to the corner tab.
Figure 3:
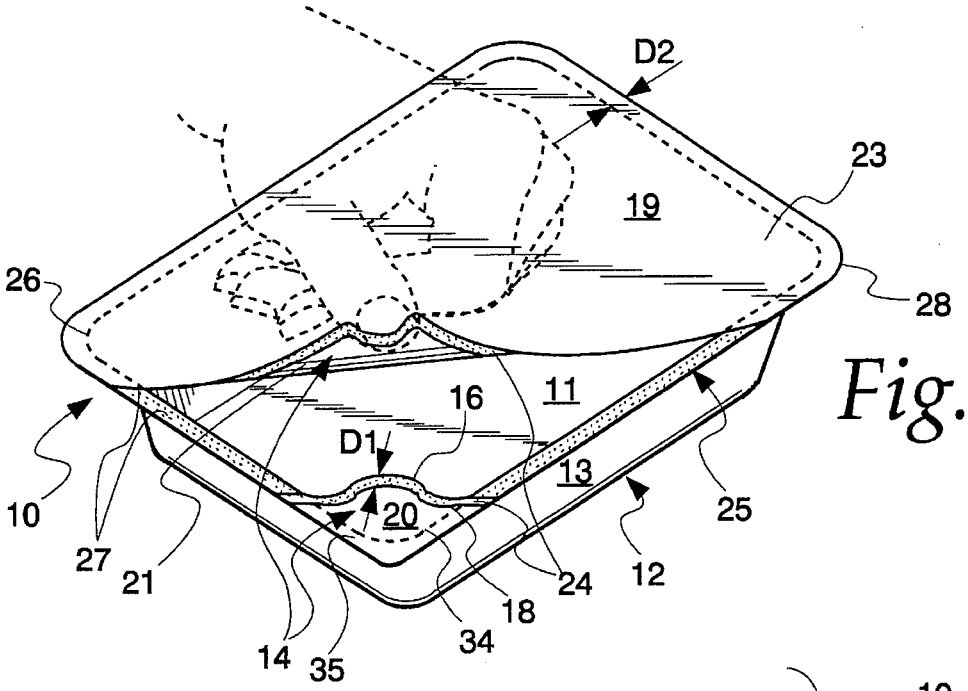
FIG. 3 is a perspective view of the tray-lid assembly illustrating the pulling back of the main section of the lid away from the rim of the tray.
Figure 4:
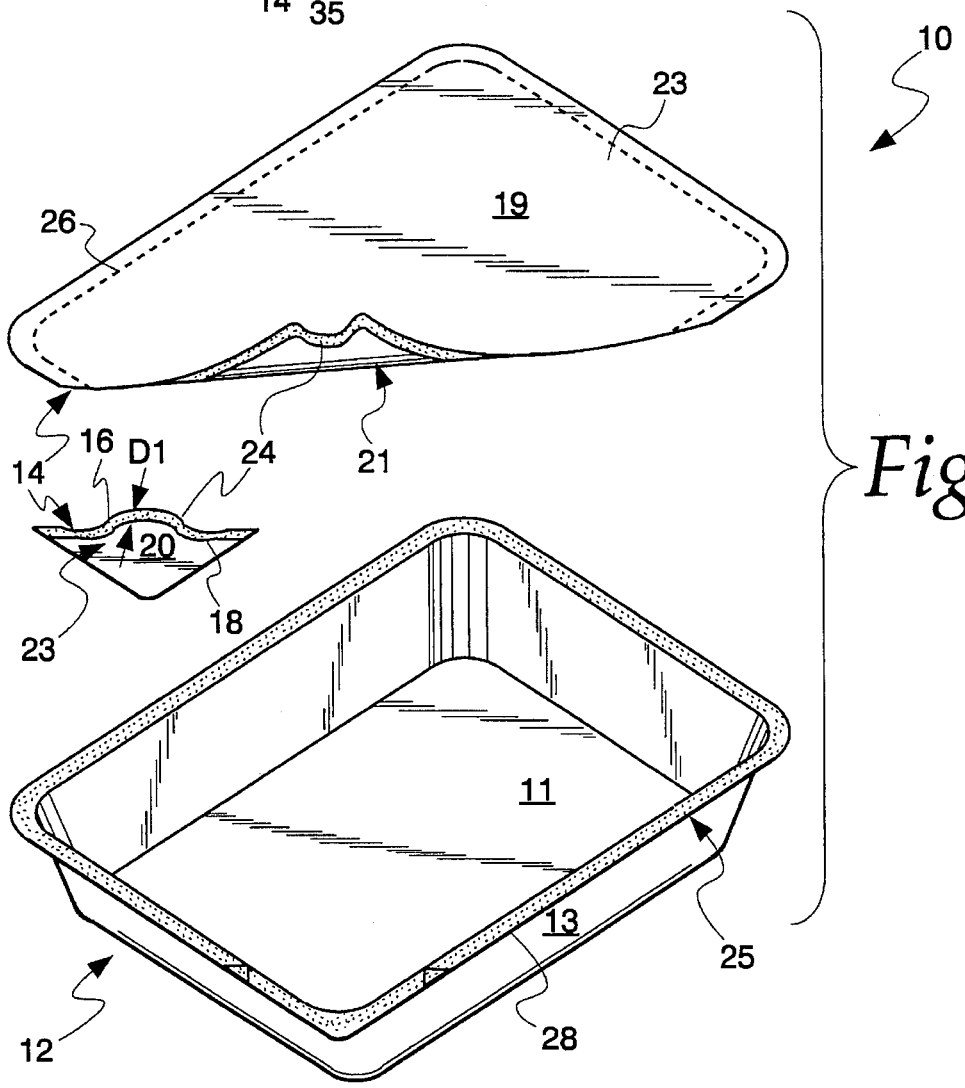
FIG. 4 is an exploded perspective view of the tray-lid assembly illustrating the main section and corner tab of the lid detached and removed from the tray.
Figure 5:
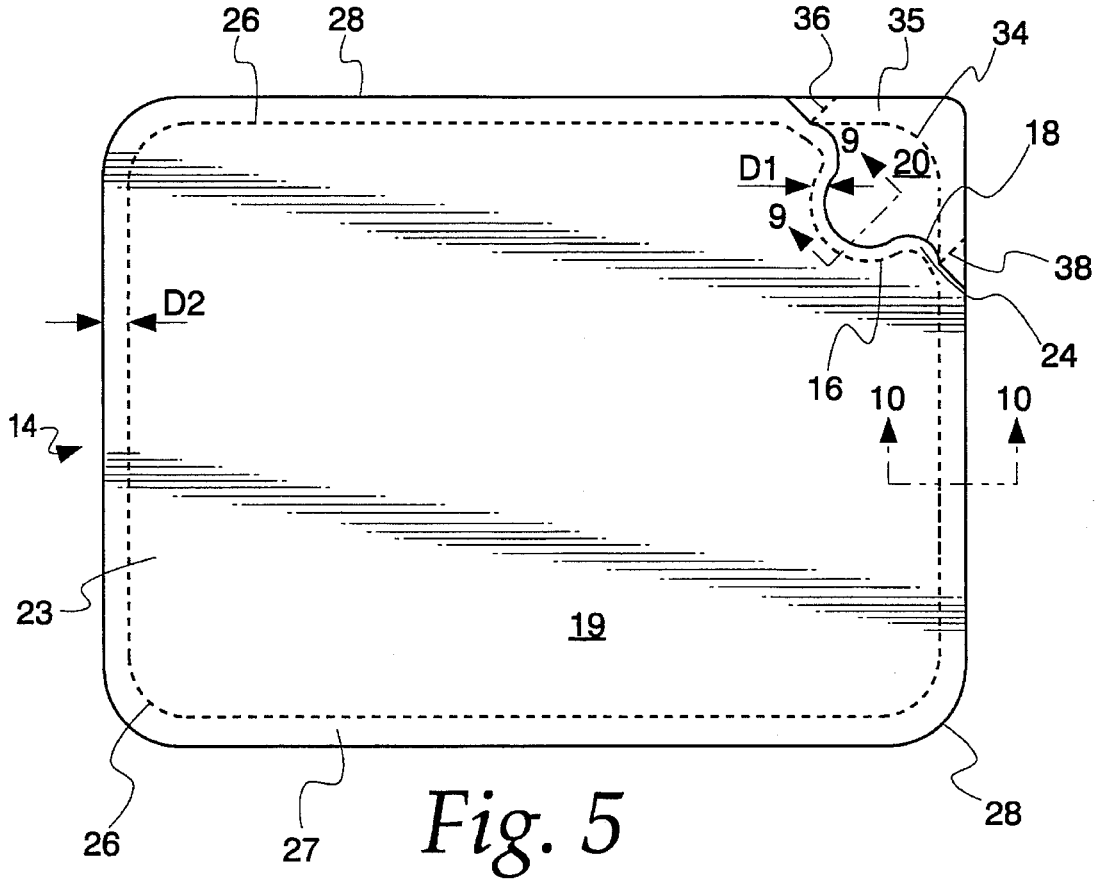
FIG. 5 is a top view of the lid.
Figure 6:
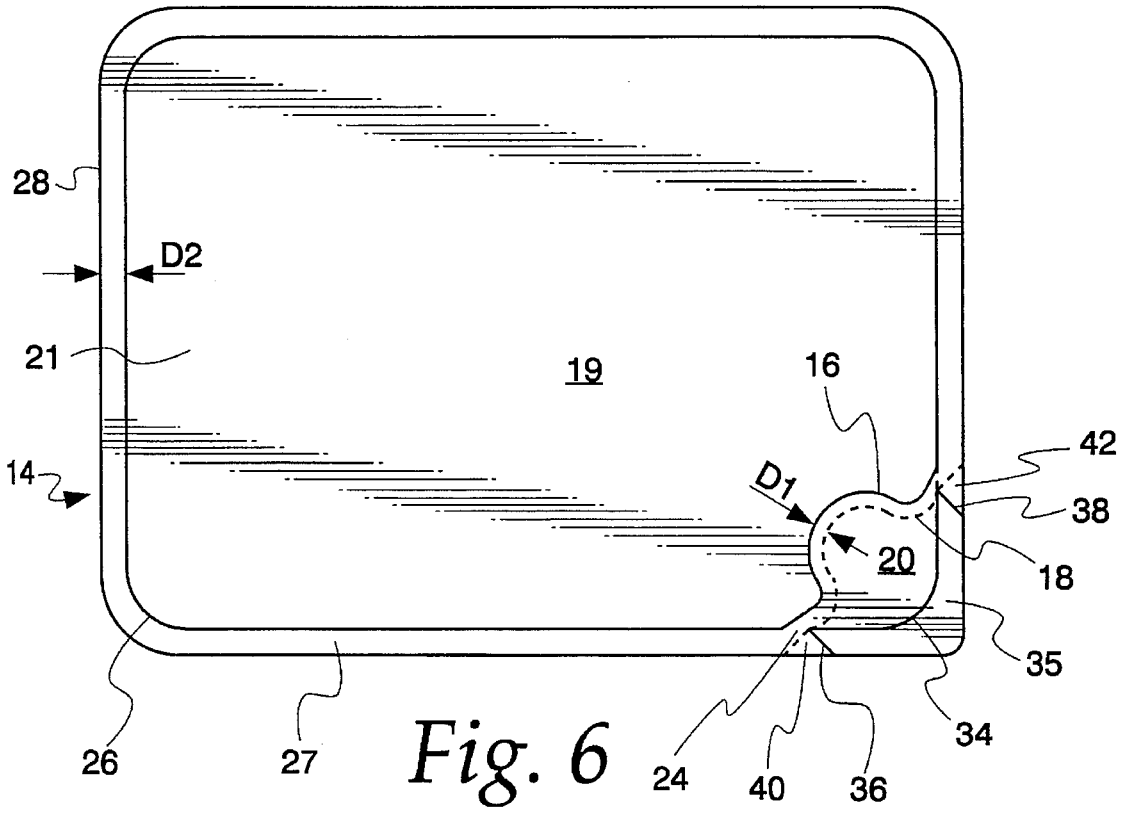
FIG. 6 is a bottom view of the lid.
Figure 7:
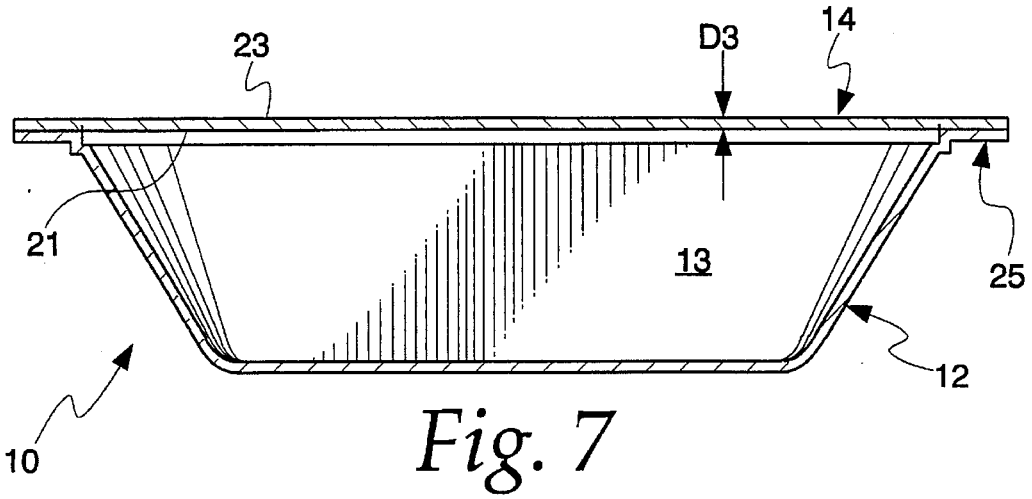
FIG. 7 is a cross-sectional view illustrating the lid and the tray before the lid is detached from the tray.

As illustrated in FIGS. 1–6 and 9, the tray-lid assembly 10 includes a first inside cut score 16 and an outside cut score 18. The first inside cut score 16 is formed in the lower surface 21 of the lid 14. The outside cut score 18 is formed in an upper surface 23 of the lid 14. The outside cut score 18 bridges a periphery of the lid 28 at two points to divide the lid 14 into a main section 19 and a relatively small corner tab 20. The separation of the main section 19 and the corner tab 20 is illustrated in FIGS. 3 and 4.

The first inside cut score 16 and the outside cut score 18 are in proximity to each other and form a rev cut such that the lid 14 delaminates, as shown in FIG. 1, in a first delamination region 24 between the first inside cut score 16 and the outside cut score 18 in response to pressing down on the corner tab 20. The main section 19, shown in FIG. 3 and 4, is comprised of the lid 14 less the area of the corner tab 20. As illustrated in FIGS. 3–6, the first delamination region area 24 exists between the first inside cut score 16 and the outside cut score 18. The main section 19 includes the upper surface 23 of the delamination region 24 after delamination, but the lower surface 21 of the delamination region 24 forms a section of the corner tab 20. After the delamination region 24 has been delaminated, a vent opening is created between the first inside cut score 16 and the outside cut score 18. The vent opening is capable of being enlarged by starting the process of removing the main section 19 as illustrated in FIG. 3.

As shown in FIGS. 3–6, the delaminated region 24 has a width D1 between about ⅛ inches and about ¼ inches. The greater the width D1, the more difficult it is for a consumer to break the surface of delaminated region 24. As the width D1 becomes shorter, the surface of delaminated region 24 breaks much easier. The width D1 is preferably greater than about ⅛ inches to prevent the breaking of the lid 14 during shipping and stacking of the tray-lid assemblies 10. Thus, a compromise exists between consumer friendliness and burst strength for top load compression.

Consumer friendliness of the tray-lid assembly 10 also applies to the first inside cut score 16 and the outside cut score 18 which are preferably arc shaped and generally curvilinear in shape. The first inside cut score 16 and outside cut score 18 are also preferred to be generally parallel because delamination is easier and a smoother cut will occur. The first inside cut score 16 and the outside cut score 18 provide a convenient opening means because the shape is thumb contoured which enables a consumer to easily delaminate the delamination region 24 with a downward force. The downward force is preferably applied by grasping the tray-lid corner between the thumb and forefinger of a user and pressing down with the thumb, as illustrated in FIG. 1.

Figure 9:
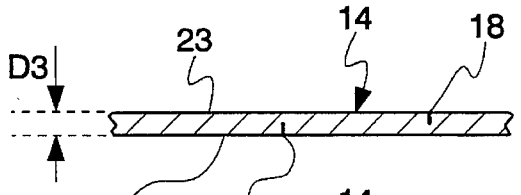
FIG. 9 is a sectional view taken substantially along line 9—9 in FIG. 5.
Figure 10:
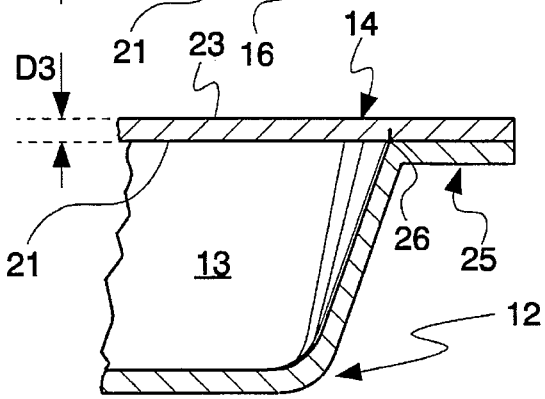
FIG. 10 is a sectional view taken substantially along line 10—10 in FIG. 5.

The first inside cut score 16 and outside cut score 18 are also illustrated in FIG. 9. The first inside cut score 16 and the outside cut score 18 each have a cut depth into the paperboard lid 14 from about 40 to 60 percent of a thickness D3 of the lid 14. A vertical margin of about 20 percent remains between cut scores 16 and 18 when each of the cut scores 16 and 18 have a cut depth of about 40 percent. A 40 percent cut depth is defined as a cut score extending 40 percent of the total thickness D3 of the lid 14. If the cut depths of the first inside cut score 16 and the outside cut score 18 are increased to about 60 percent of the thickness D3 of the lid 14, delamination will be easier for the consumer and the resulting cut is less likely to leave a jagged edge.

As shown in FIGS. 1–6 and 10, the tray-lid assembly 10 has a peripheral second inside cut score 26 formed in the lower surface 21 of the lid 14 and is disposed alongside a periphery 28 of the lid 14. The second inside cut score has a cut depth ranging from about 30 percent to about 60 percent of the thickness D3 of the lid 14, with the optimal depth cut score ranging from about 55 percent to 60 percent. The second inside cut score 26 is located a distance between about ⅛ inches and about ⅜ inches from the periphery 28 of the lid 14 and intersects the first inside cut score 16. Preferably, the optimal range is between about 3/16 inches and 5/16 inches which generally corresponds to a predefined width of the lateral tray flange 25. If the distance of the second inside cut score 26 from the periphery 28 is too large, the lid 14 could fail to delaminate properly.

A second delamination region 27 is located between the second inside cut score 26 and the periphery of the lid 28. This second delamination region 27 delaminates in response to pulling upwardly on the main section 19 of the lid 14 near the corner tab 20. The periphery 28 of the lid 14 is preferably different around the corner tab 20 to enable a consumer to recognize easier where to properly begin opening the lid 14. In the preferred embodiment the periphery 28 forms a sharper corner at tab 20 than at the remaining three corners.

Figure 8:
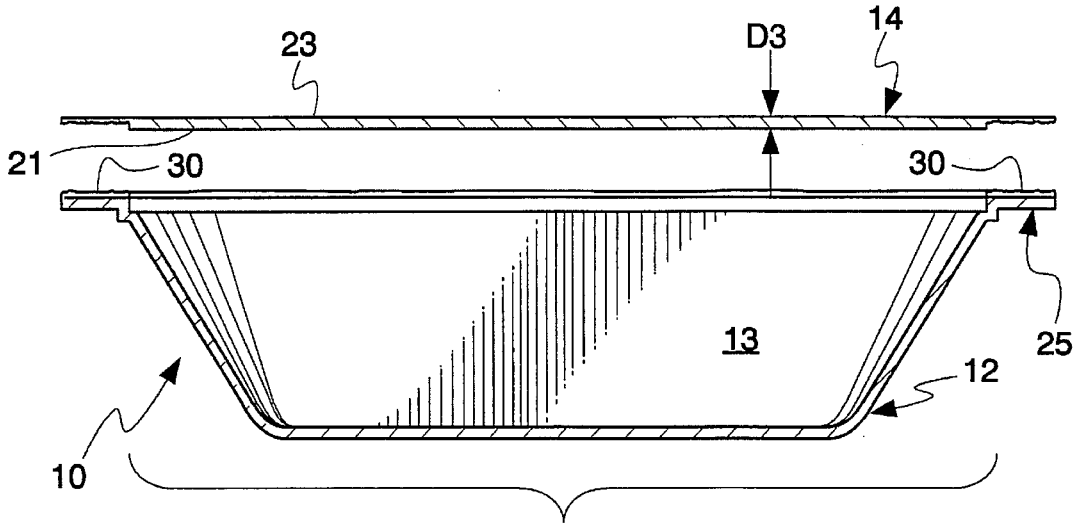
FIG. 8 is an exploded cross-sectional view illustrating the lid and the tray after the lid is detached from the tray.

When the lid 14 is removed from the tray flange 25, after being affixed thereto, delaminated portions of paperboard 30 remain on flange 25, as shown in FIG. 8. However, because the peripheral second inside cut score 26 generally corresponds to and optimally is at a preferred distance from the periphery 28 no greater than the width of the tray flange 25, the delaminated portions 30 remaining on the flange 25 do not extend beyond the inner edge of the flange 25 and into the containment cavity. Consequently, removal of the lid 14 from the tray 12 does not leave any overhanging portion or obstruction about the tray flange 25 which can lead to inefficient and incomplete pouring out of food or liquid product contained within the tray.

As illustrated in FIG. 1–6, a peripheral third inside cut score 34 is formed in the lower surface 21 of the lid 14 and preferably is disposed alongside the periphery 28 of the lid 14 at the corner tab 20, while intersecting the outside cut score 18. The third inside cut score facilitates the removal of corner tab 20, as illustrated in FIG. 4. The preferred cut depth for the peripheral third inside cut score 34 is the same as described above for the second inside cut score 26. A third delamination region 35 is formed between the third inside cut score 34 and the periphery 28 of the lid 14. This third delamination region 35 delaminates in response to pulling upwardly on the corner tab 20.

A fourth inside cut score 36 and a fifth inside cut score 38 are formed in the lower surface 21 of the lid 14 as illustrated in FIGS. 1, 2, 5 and 6. The preferred cut depth for the fourth inside cut score 36 and the fifth inside cut score 38 are the same as described above for the second inside cut score 26. The fourth inside cut score 36 and the fifth inside cut score 38 preferably extend from opposite ends of the outside cut score 18 to the periphery 28 of the lid 14. The fourth inside cut score 36 and the fifth inside cut score 38 are each approximately 45 degrees away from the third inside cut score 34. The preferred location of the cut scores 36 and 38 result in easier removal of the corner tab 20 as illustrated in FIG. 4. The corner tab 20 does not have to be removed, but preferably is removed for easier pouring, easier material removal and aesthetic reasons.

When removing the corner tab 20, two small triangular areas 40 and 42 should remain on the tray flange 25. The triangular area 40 is bounded by the fourth inside cut score 36, the outside cut score 18 and the periphery 28 of the lid 14. The triangular area 42 is bounded by the fifth inside cut score 38, the outside cut score 18 and the periphery 28 of the lid 14. The two triangular areas 40 and 42 are readily apparent in FIGS. 5 and 6.

The present invention further contemplates a method of opening the tray-lid assembly 10. A user first presses the corner tab 20 in a downward direction to cause the lid 14 to delaminate in the delamination region 24 between the inside cut score 16 and the outside cut score 24, which results is the formation of a cooking vent. This step is best illustrated in FIG. 1. Next, the user grasps the main section 19 of the lid 14 in proximity to the corner tab 20, as illustrated in FIG. 2. The user pulls upwardly on the main section 19 in a direction away from the tray 12 to substantially remove the main section 19 from the tray 12, as illustrated in FIG. 3.

The method of opening the tray-lid assembly 10 also preferably removes the corner tab 20. The user removes the corner tab 20 by grasping and pulling upwardly on the corner tab 20 in a direction away from the tray 12 to substantially remove the corner tab 20 from the tray 12. FIG. 4 illustrates the corner tab 20, as well as the main section 19, after being removed from the tray 12.

While the present invention has been described with reference to one or more particular embodiments, those skilled in the art will recognize that many changes may be made thereto without departing from the spirit and scope of the present invention. Each of these embodiments and obvious variations thereof are contemplated as falling within the spirit and scope of the claimed invention, which is set forth in the following claims.

What is claimed is:

1. A tray-lid assembly comprising:

a tray including a bottom panel, a continuous wall panel, and a continuous rim, said continuous wall panel encompassing said bottom panel and extending upwardly from said bottom panel, said continuous rim encompassing an upper edge of said continuous wall panel and projecting laterally outwardly therefrom; and a lid including an upper surface and a lower surface, said lower surface of said lid being detachably connected to the continuous rim, said lid having a first inside cut score formed in said lower surface of said lid, said lid having an outside cut score formed in said upper surface of said lid, said outside cut score bridging the periphery of said lid at two points and forming a corner tab, said first inside cut score and said outside cut score being in proximity and forming a rev cut such that said lid delaminates in a delamination region between said first inside cut score and said outside cut score in response to pressing down on said corner tab.

2. The tray-lid assembly of claim 1 wherein said first inside cut score and said outside cut score are arc shaped.

3. The tray-lid assembly of claim 2 wherein said first inside cut score is generally parallel to said outside cut score.

4. The tray-lid assembly of claim 3 wherein said delamination region has a width between about ⅛ inches and about ¼ inches.

5. The tray-lid assembly of claim 1 wherein said lid further includes a peripheral second inside cut score formed in said lower surface of said lid and disposed alongside the periphery of said lid, said second inside cut score intersecting said first inside cut score.

6. The tray-lid assembly of claim 5 wherein said peripheral second inside cut score is located a distance between about ⅛ inch and about ⅜ inch from the periphery of said lid.

7. The tray-lid assembly of claim 6 wherein said continuous rim of said tray has a width generally corresponding to the distance of said second inside cut score from the periphery of said lid.

8. The tray-lid assembly of claim 5 wherein said lid further includes a peripheral third inside cut score formed in said lower surface of said lid and disposed alongside the periphery of said lid at said corner tab, said third inside cut score intersecting said outside cut score.

9. The tray-lid assembly of claim 8 wherein said lid further includes fourth and fifth inside cut scores formed in said lower surface of said lid and extending from respective opposite ends of said outside cut score to the periphery of said lid.

10. The tray lid assembly of claim 9 wherein said fourth and fifth inside cut scores extend from respective opposite ends of said third inside cut score to the periphery of said lid, said fourth and fifth inside cut scores each being approximately 45 degrees away from said third inside cut score.

11. A tray-lid assembly comprising:

a tray including a bottom panel, a continuous wall panel, and a continuous rim, said continuous wall panel encompassing said bottom panel and extending upwardly from said bottom panel, said continuous rim encompassing an upper edge of said continuous wall panel and projecting laterally outwardly therefrom; and a lid including an upper surface and a lower surface, said lower surface of said lid being detachably connected to the continuous rim, said lid having a first inside cut score formed in said lower surface of said lid, said lid having an outside cut score formed in said upper surface of said lid, said outside cut score bridging the periphery of said lid at two points to divide said lid into a main section and a relatively small corner tab, said first inside cut score and said outside cut score being generally parallel and in proximity to each other, said first inside cut score and said outside cut score forming a rev cut such that said lid delaminates in a first delamination region between said first inside cut score and said outside cut score in response to pressing down on said corner tab.

12. The tray-lid assembly of claim 11 wherein said first inside cut score and said outside cut score are generally curvilinear in shape.

13. The tray-lid assembly of claim 11 wherein said lid further includes a peripheral second inside cut score formed in said lower surface of said lid and disposed alongside the periphery of said lid at said main section, said second inside cut score intersecting said first inside cut score such that said lid delaminates in a second delamination region between said second inside cut score and the periphery of said lid in response to pulling upwardly on said main section of said lid near said corner tab.

14. The tray-lid assembly of claim 13 wherein said lid further includes a peripheral third inside cut score formed in said lower surface of said lid and disposed alongside the periphery of said lid at said corner tab, said third inside cut score intersecting said outside cut score such that said lid substantially delaminates in a third delamination region between said third inside cut score and the periphery of said lid in response to pulling upwardly on said corner tab.

15. The tray-lid assembly of claim 14 wherein said lid further includes fourth and fifth inside cut scores formed in said lower surface of said lid at said corner tab and extending from respective opposite ends of said outside cut score to the periphery of said lid.

16. A lid for a tray-lid assembly, said lid comprising an upper surface and a lower surface, said lower surface of said lid being detachably connected to a tray of the tray-lid assembly, said lid having a first inside cut score formed in said lower surface of said lid, said lid having an outside cut score formed in said upper surface of said lid, said outside cut score bridging the periphery of said lid at two points and forming a corner tab, said first inside cut score and said outside cut score being in proximity and forming a rev cut such that said lid delaminates in a delamination region between said first inside cut score and said outside cut score in response to pressing down on said corner tab.

17. The lid of claim 16 wherein said first inside cut score and said outside cut score are generally parallel to each other and are curvilinear in shape.

18. The lid of claim 17 wherein said delamination region has a width between about ⅛ inches and about ¼ inches.

19. The lid of claim 16 wherein said lid further includes second and third inside cut scores formed in said lower surface of said lid and extending from respective opposite ends of said outside cut score to the periphery of said lid.

20. A method of opening a tray-lid assembly comprising a tray and a lid, said lid comprising an upper surface and a lower surface, said lower surface of said lid being detachably connected to said tray, said lid having an inside cut score formed in said lower surface of said lid, said lid having an outside cut score formed in said upper surface of said lid, said outside cut score bridging the periphery of said lid at two points to divide said lid into a main section and a relatively small corner tab, said inside cut score and said outside cut score being in proximity and forming a rev cut, said method comprising the steps of:

pressing said corner tab in a downward direction to cause said lid to delaminate in a delamination region between said inside cut score and said outside cut score, thereby forming a cooking vent;

grasping said main section of said lid in proximity to said corner tab; and pulling upwardly on said main section in a direction away from said tray to substantially remove said main section from said tray.

21. The method of claim 20 further comprising the steps of:

grasping said corner tab; and pulling upwardly on said corner tab in a direction away from said tray to substantially remove said corner tab from said tray.

* * * * *